United States Patent [19]

Gress

[11] Patent Number: 5,035,535

[45] Date of Patent: Jul. 30, 1991

[54] DEVICE FOR REGULATING THE FLOW IN A DRAINAGE SIPHON TUBE

[75] Inventor: Jean-Claude Gress, Fontaines, France

[73] Assignee: Gress S.A., Fontaines, France

[21] Appl. No.: 532,031

[22] Filed: Jun. 1, 1990

[30] Foreign Application Priority Data

Jun. 2, 1989 [FR] France ..... 89 07561

[51] Int. Cl.[5] ..... E02B 11/00

[52] U.S. Cl. ..... 405/50; 137/142; 137/144; 405/36; 405/92

[58] Field of Search ..... 405/36–42, 405/50, 44, 52, 59, 43, 45, 92; 166/54, 268, 266, 52; 137/123, 132, 142, 144, 152

[56] References Cited

U.S. PATENT DOCUMENTS

| | | | |
|---|---|---|---|
| 100,786 | 3/1870 | Moyer | 137/142 X |
| 205,779 | 7/1878 | Worthen | 166/52 |
| 1,151,608 | 8/1915 | Paech | 405/50 |
| 1,286,666 | 12/1918 | Layne | 405/50 X |
| 2,018,110 | 10/1935 | Auter | 137/144 |
| 2,068,363 | 1/1937 | Wetmore et al. | 137/144 |
| 2,176,540 | 10/1939 | Moore | 166/54 |
| 2,363,313 | 11/1944 | Gavin | 137/144 X |
| 4,222,520 | 9/1980 | Melcher | 405/36 X |
| 4,260,284 | 4/1981 | Huart | 405/50 X |

FOREIGN PATENT DOCUMENTS

| | | | |
|---|---|---|---|
| 289166 | 8/1971 | U.S.S.R. | 405/40 |

*Primary Examiner*—Dennis L. Taylor

*Attorney, Agent, or Firm*—Collard, Roe & Galgano

[57] ABSTRACT

A device for regulating the flow in a drainage siphon tube, includes a rigid tube connected to the outlet end of the siphon tube. The rigid tube is placed on a brace such that it can oscillate around a horizontal axis by means of a counter-weight. Pivoting upward of the tube is limited by a high block stop and pivoting downward is limited by a low block stop in such a way that when the siphon tube is delivering above its critical point, the tube is tilted downward, resting on the lower block stop and when the critical outflow is reached, the tube empties itself and comes to rest against the higher block stop by means of the counterweight. An increase in the pressure at the inflow end of the siphon tube results in a rise of the water in the rigid tube until the imbalance makes it pivot to the downward tilted position where it rests on the low block stop and delivery higher than the critical point ejects the gas bubbles accumulated at the high point of the siphon tube.

5 Claims, 2 Drawing Sheets

DEVICE FOR REGULATING THE FLOW IN A DRAINAGE SIPHON TUBE

BACKGROUND OF THE INVENTION

The present invention relates to a device for regulating the flow in a siphon tube assembly. More particularly, it relates to a device fitted to the outlet end of a drainage siphon tube, allowing it to function continuously, or intermittently, with an overflow superior to a defined minimal critical outflow determined by on-site parameters.

In my earlier patent, U.S. Pat. No. 4,717,284, I disclose a device for draining soils in depth, the subject matter of which is incorporated herein.

French Patent No. 2,593,203 and European Patent Application No. EP 0 230 918 disclose a drainage siphon device capable of functioning continuously, and in an autonomous way, without the risk of unpriming, as a result of which there is no need for repeated care or systematic surveillance. While satisfactory in the great majority of situations encountered in the field, it happens, however, that the functioning of this device is, under certain circumstances, problematic where the water to be siphoned comprises a significant amount of dissolved gases. When the water rises within the tube forming the siphon, its pressure decreases and part of the gas is freed in the form of bubbles. These bubbles are drawn along the water flow as long as the latter remains adequately strong. However, below a certain minimum outflow, called a "critical point" the bubbles are no longer drawn along but instead they all rise to the highest point of the siphon, meet there and form a large bubble by coalescence.

Tubes of interior diameter superior to the 10 mm and those whose interior diameter is less than 6 mm present noticeably different behaviors.

In the last case (6 mm and less) when the critical point is reached, the bubbles take up or occupy the entire cross section of the siphon tube, as a result of which outflow is stopped. At the same time, the continuous feed flow from the borehole in which the drain is placed results in an increase in the water level within the drain and thus, an increase in the hydrostatic pressure. This increased pressure reaches a point where it is strong enough to completely eject the large bubble which has accumulated at the highest point, following which the siphon tube works normally again until it enters a new "stopping phase", caused by reaching the "critical point" again and the formation of another bubble.

For tubes of a diameter larger than approximately 10 mm, the bubble stagnating at the highest point of the siphon tube does not at first, take up the whole cross-section of the tube and allows for a certain time a certain outflow until, by coalescence, it also is large enough to totally stop the outflow. Here too, the hydrostatic pressure increases in the borehole until it is strong enough to eject the bubble and allow the outflow to resume. However, the pressure necessary to eject the bubble can, in certain situations be unacceptable or at least undesirable. As discussed in the above patents, this problem can be solved by equipping the drain with several siphon tubes of different diameters, working simultaneously or in turn, according to temporary conditions. However, this solution requires fittings which can be costly, cumbersome and complicated due to the several siphon tubes involved.

SUMMARY OF THE INvENTION

Accordingly, it is an object of the present invention to overcome these disadvantages in the actual state of the art by providing a device that can work continuously and in an autonomous way with no risk of unpriming, which has no external energy requirements and which needs no repeated care or systematic surveillance.

It is a more particular object of the present invention to provide such a device which allows the automatic interruption of siphoning when the outflow is below the "critical point", and the automatic resumption of siphoning under a hydrostatic pressure defined for the site drained.

Certain of the foregoing and related objects are achieved in a device for regulating the flow in a drainage siphon tube assembly of the type having a siphon tube with an inlet end and an outlet end, and at least one drain support tube arranged within a drainage borehole having a lower end defining a reservoir with a top lip disposed at the same altitude level as said siphon tube outlet end. The device includes a support disposed adjacent the siphon tube outlet end, means for pivotably mounting the outlet end of the siphon tube on the support for pivotable movement about a horizontal axis, and a rigid tube having one free end and an opposite end coupled to said outlet end of the siphon tube. A counterweight cooperates with the outlet end of the siphon tube to cause the free end of the rigid tube to pivot upwardly to a predetermined high point when there is no flow and to alternatively pivot downwardly to a predetermined low point when there is a flow.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

In the following, the invention is described within an example of the drainage situation of a slope or a site where the land is likely to slide and the drain is placed in a borehole. It should be evident that the example is not restrictive and that the invention may find application in many other cases, according to site particularities, as is evident to one skilled in the art.

Figure 1:
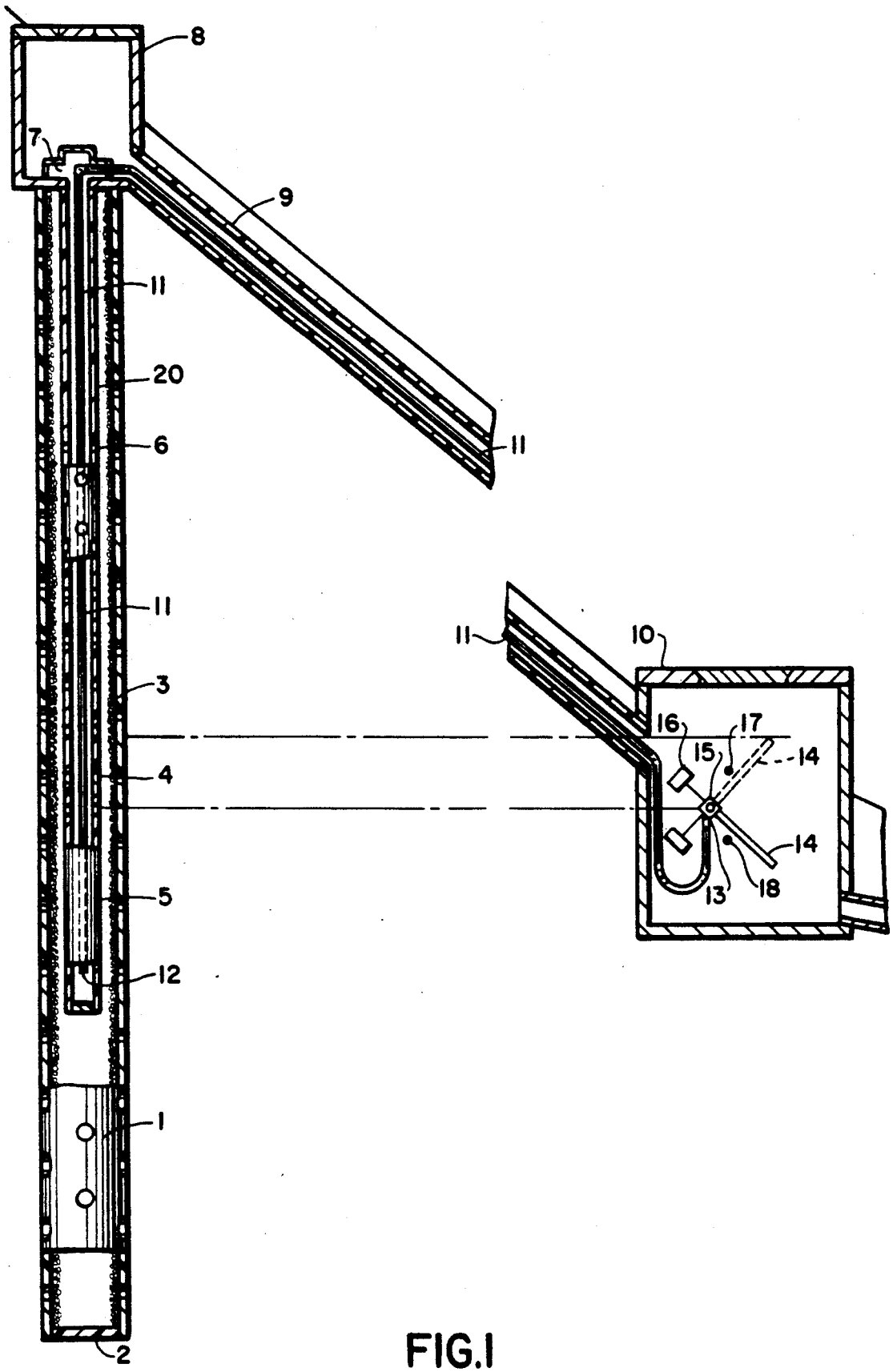
FIG. 1 is a schematic sectional side view of a drainage installation fitted with a device according to the invention.

Thus, turning now in particular to FIG. 1, the drain represented is vertical but any gradient giving a descending penetration of the drain toward the inflow end is possible without changing the working principle. The drain is shown within a borehole but, as stated above, could also be driven, vibrated or cast, according to known techniques. It comprises a first tube 1, for example made of plastic material suitable for this use. The section of tube 1 in contact with water is perforated so that it acts as a strainer when performing its draining function. Preferably, tube 1 is closed off at its lowest end by a plug 2 to avoid the entry of particles into the end of the drain. If desired, filter material 3 may also be placed between the walls of the borehole and tube 1.

A second tube 20 made also, for example, of a suitable plastic material is placed within tube 1. The mid-section 4 of tube 20 is perforated 4 so that it too acts as a strainer; it can also be protected by filter material or a second filter (not shown). The lower end of second tube 20 is advantageously closed and its sides imperforate to form a reservoir or tank 5. The top section 6 of tube 20 has imperforate walls 6 and ends in, at least one radial side outlet 7 and, optimally, according to what is practical due to site conditions, four radial outlets 7 arranged in a cross to allow access to and provide mechanical support for the operating end of a siphon tube 11. Top section 6 is best placed in a watch hole. From this watch hole, a pipe 9 made of an appropriate plastic material extends to another watch hole called an outlet watch hole 10. Pipe 9 is kept below the frost line to shield it from climatic influences.

An end 12 of siphon tube 11 extends permanently into second tube 20 with its lower end in reservoir 5. From reservoir 5 it extends upwardly through strainer section 4 and up through the imperforate top section 6 and out of one of the radial outlets 7 at which point tube 11 has an intermediate section which is nearly horizontal. The following section of tube 11 descends through a tube 9, disposed preferably below the frostline and shielded from climatic influences, to an outlet housing that is disposed on the same level as the top part or lip of reservoir 5 so that the siphon can work without ever emptying the reservoir.

Figure 2:
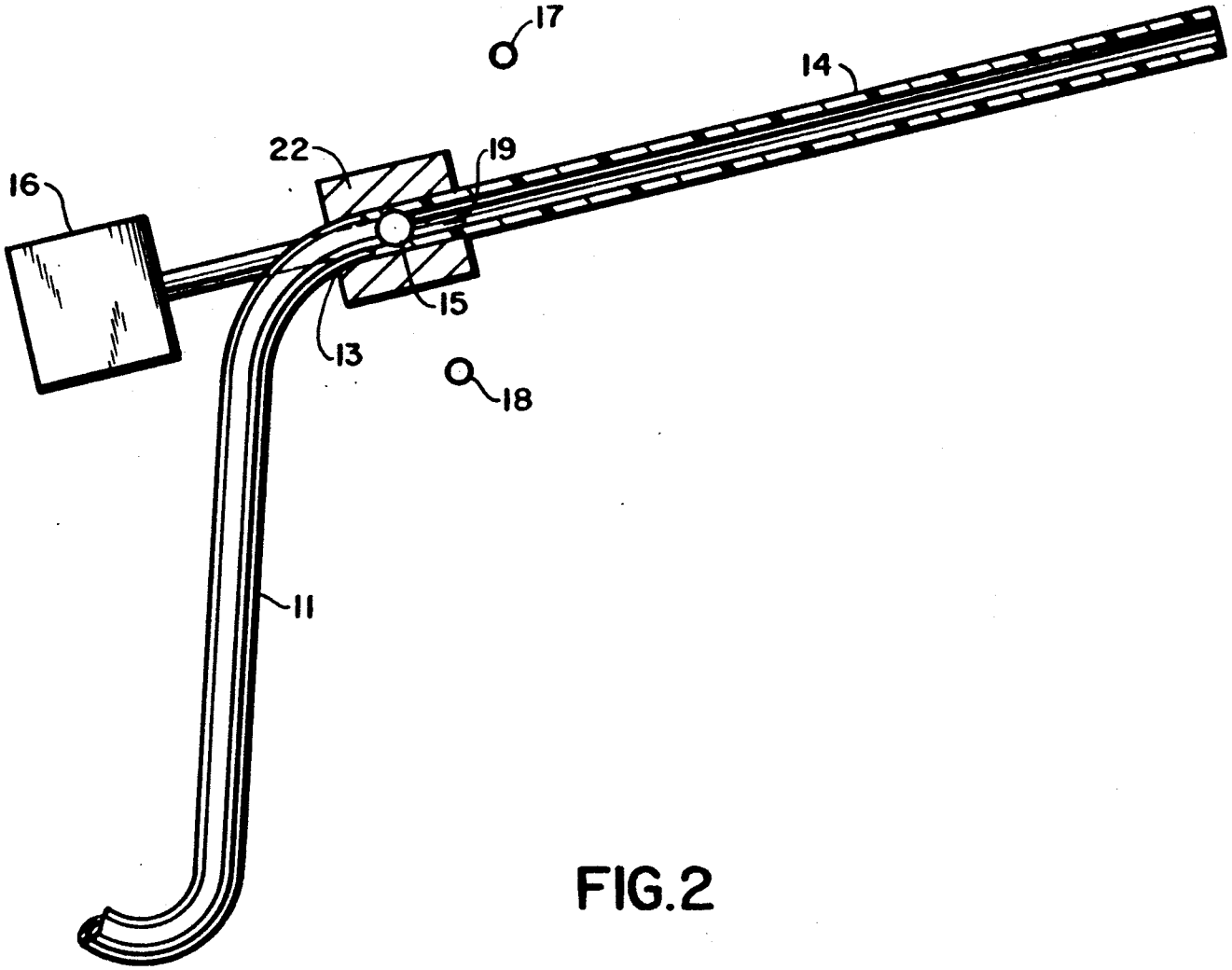
FIG. 2 is an enlarged schematic sectional view of a portion of the device shown in FIG. 1.

However, to overcome the disadvantages discussed above due to the evolution and the coalescing of bubbles at the highest point of the siphon tube 11 the end 13 of siphon tube 11 is set up in an outlet watch hole 10 of the siphon tube 11 on the same level as the top lip of reservoir 5. As seen best in FIG. 2, it is hooked up either directly or, preferably, by a rotating coupling 19 to a rigid tube 14. This rigid tube 14 can pivot about a horizontal axis or axle 15, held up by a support or brace 20 and counterbalanced by the action of a counterweight 16. The pivot travel or run of the tube is limited above and below by a high block stop 17 and a low block stop 18. The siphon can be primed by injecting water into the end of the rigid tube 4 until all the air has been cleared out of the siphon tube 11 and the water within the line passes through outlet end 13 of siphon tube 11. Then, upon stopping the injection of water, and the water pressure within the drain with regard to the outlet end 13 of the siphon induces the siphoning function of the drainage system. Preferably, the end 13 of siphon tube 11 is equipped before reaching the level of the rotation axis 15, with a flexible U-shaped member which assists the free up or down movements of the rigid tube 14. With the weight of the water in the rigid tube 14 being the motive force with regards to counterweight 16, this tube comes to rest against the lower block stop 18. The siphon then has an outflow superior to the critical point mentioned above.

When the flow slackens and reaches the critical point, the flow within tube 14 begins to trickle, i.e., it flows with a free surface, and by means of predetermined equilibration, counterweight 16 unbalances tube 14 when it is practically empty. The free end of tube 14 then rises and strikes the top block stop 17. The siphon then stops delivering. If normal feeding of the drain allows a rise in the water, it will be accompanied by a rise in the water within rigid tube 14. The weight of the water contained in tube 14 will then be the motive force with regards to counterweight 16 and the tube will again come to hit the lower block stop 18. Given an appropriate positioning of the upper and lower block stops 17, 18 relative to the length of the rigid tube, the unbalancing will occur at a pressure in the drain allowing outflow beyond the critical point until a new stopping period begins.

After priming, as described above, water entering the drain at atmospheric pressure, contains a certain proportion of dissolved gases. When the water rises upwardly in siphon tube 11 its pressure slackens and gas bubbles appear. As long as the outflow is rapid enough, these bubbles are evacuated by the water flow. However, at the critical point, the bubbles are no longer evacuated. At the same time, as rigid tube 14 empties itself, bubbles in siphon tube 14 cause it to tip over. After tipping of tube 14, the new hydraulic pressure between the water level in the drain and the bottom end of tube 14 will produce a turbulent outflow within siphon tube 11 which will carry along with it the stationary bubble at the high point of siphon tube 11. The volume of water evacuated from the drain by siphon tube 11 during the turbulent outflows must absolutely be superior to the volume of the siphon tube in order to clear all the bubbles.

From the above, it is clear that, as a result of the end 12 of the siphon tube 11 being constantly submerged in reservoir 5, the siphon tube can never become unprimed from that end, even when the borehole is completely empty, e.g., during a dry spell, since the water level always stays at least up to the top lip of the reservoir 5. In this case, the siphon will, of course, not function since there is no water to drain, but as soon as new water infiltration enters the drain and allows, by induced pressure, the rise of the water in tube 14 and, consequently, its downward tipping, the siphon will be reactivated. The entry of air into the end of tube 14 has no harmful effect since, when it happens, it initiates upward tipping of the tube around axis or axle 15.

It should be noted that the device described can be used to set u individual drains or parallel drains with a common outlet or different outlets in a structure suitable to any site and complementary with other drainage systems. Moreover, for one drainage system, several siphoning tubes of different diameters may be set up, each hooked up to an individual reservoir 5 and an individual tube 14, adapting the geometry of the system to the outflows to be extracted and, thus to the aquiferous configuration of any site.

Thus, while only one embodiment of the present invention has been shown and described, it is obvious that many changes and modifications ma be made thereunto without departing from the spirit and scope of the invention.

What is claimed is:

1. A device for regulating the flow in a drainage siphon tube assembly of the type having a siphon tube with an inlet end and an outlet end, and at least one drain support tube arranged within a drainage borehole having a lower end defining a reservoir with a top lip disposed at the same altitude level as said siphon tube outlet end, comprising:

a support disposed adjacent said siphon tube outlet end;

means for pivotably mounting said outlet end of said siphon tube on said support for pivotable movement about a horizontal axis;

a rigid tube having one free end and an opposite end coupled to said outlet end of said siphon tube; and a counterweight cooperating with said outlet end of said siphon tube to cause the free end of said rigid tube to pivot upwardly to a predetermined high point when there is no flow and to alternatively pivot downwardly to a predetermined low point when there is a flow.

2. The device according to claim 1, wherein said siphon tube outlet end defines an outlet, and said siphon tube additionally includes a flexible U-shaped member coupled thereto adjacent said outlet end thereof immediately below said outlet.

3. The device according to claim 1, additionally including a high block stop and a low block stop disposed adjacent said free end of said rigid tube, said high block stop being positioned to limit upward pivoting of said free end to said predetermined high point and said lower block stop being positioned to limit downward pivoting of said free end to said predetermined low point.

4. The device according to claim 1, additionally including a rotatable coupling for coupling said outlet end of said siphon tube to said rigid tube.

5. The device according to claim 1, wherein said device is mounted within an outlet housing accessible by a watch hole.

* * * * *